US006042779A

United States Patent [19]

Oschmann et al.

[11] Patent Number: 6,042,779

[45] Date of Patent: Mar. 28, 2000

[54] EXTRUSION FABRICATION PROCESS FOR DISCONTINUOUS CARBIDE PARTICULATE METAL MATRIX COMPOSITES AND SUPER HYPEREUTECTIC A1/SI

[75] Inventors: Edward L. Oschmann, Fort Wayne, Ind.; Thomas G. Haynes, Midlothian, Va.

[73] Assignee: Reynolds Metals Company, Richmond, Va.

[21] Appl. No.: 09/126,517

[22] Filed: Jul. 30, 1998

[51] Int. Cl.[7] ..... B22F 3/20; B22F 3/24

[52] U.S. Cl. ..... 419/28; 419/29

[58] Field of Search ..... 419/28, 29

[56] References Cited

U.S. PATENT DOCUMENTS

| | | | |
|---|---|---|---|
| 3,645,728 | 2/1972 | Hrinevich, Jr. | 75/214 |
| 5,338,505 | 8/1994 | Tsuji et al. | 419/10 |
| 5,868,876 | 2/1999 | Bianco | 148/407 |

*Primary Examiner*—Daniel J. Jenkins
*Attorney, Agent, or Firm*—Alan M. Biddison

[57] ABSTRACT

The invention relates to a method for forming high performance metal alloys using powder metallurgy. Alloys are extruded under controlled temperature conditions through an extrusion die containing non-metal bearing inserts. This allows the extrusion of hypereutectic alloys without excessive wear of the extrusion die.

17 Claims, 3 Drawing Sheets

EXTRUSION FABRICATION PROCESS FOR DISCONTINUOUS CARBIDE PARTICULATE METAL MATRIX COMPOSITES AND SUPER HYPEREUTECTIC A1/SI

TECHNICAL FIELD

The present invention lies in the art of metallurgy, and more specifically in the field of extrusion of alloy compositions formed having a high modulus. In particular, the invention is directed to a process for extruding a metal alloy under conditions of high flow stress.

BACKGROUND OF THE INVENTION

Various techniques for forming high performance metal alloys are known. These include powder metallurgy and ingot metallurgy. Of these, powder metallurgy is of particular interest because of its unique ability to form alloys having a microstructure unachievable using more conventional techniques, such as casting.

Generally, high performance alloys may be formed by combining a matrix metal, such as aluminum, with a refractory material which forms a discontinuous phase in the matrix. Examples of refractory materials include alumina, silicon carbide, boron carbide, aluminum nitride and silicon hexaboride. The alloys formed have increased strength and modulus of elasticity compared to monolithic aluminum alloys.

However, the extrusion of such alloys is difficult, due in part to high flow stress generated during extrusion. The flow stress is a function of the high temperature strength of the alloy and reinforcement loading. As the percentage of refractory material in the matrix is increased, flow stress increases along with strength. If severe enough, the flow stress hinders commercial scale manufacturability of the alloy.

For example, discontinuous reinforced aluminum metal matrix composites are difficult to work and quickly wear out conventional steel die toolings. Hypereutectic and superhypereutectic alloys formed of these matrices generally cannot be extruded economically due to poor productivity, excessive scrap (poor recovery), extrusion die failure and excessive die wear. However, hypereutectic and superhypereutectic aluminum silicon alloys (i.e., alloys having greater than 25% and 35% silicon, respectively) would have great utility in many applications.

Prior art attempts to decrease the flow stress of such alloys have been generally unsuccessful. The approaches usually taken are to raise the billet temperature above the solidus of the alloy and/or to increase the strength of the die insert by the use of ceramics. However, when the billet temperature exceeds the solidus, the morphology of the alloy is altered. Billets formed by powder metallurgy have a substantially uniform and homogeneous microstructure, and the particulates in the billet coalesce at temperatures above the solidus, leading to grain enlargement, which in turn decreases the strength of the alloy.

The use of ceramic die inserts also has adverse consequences, such as thermal shock. This occurs when the ceramic material is rapidly heated and cooled and results in stress cracks in the ceramic which ultimately leads to catastrophic failure. To avoid thermal shock, the ceramic die inserts must be heated and cooled slowly, which greatly increases the lead time for any production run.

Hence, there remains a need in the art for a method and apparatus for extruding high performance metal alloys while leaving the physical properties of the alloys intact. There is also a need in the art for such a method and apparatus which does not require extended periods of lead time. These needs are met by the present invention.

SUMMARY OF THE INVENTION

It is accordingly an object of the invention to provide a method and apparatus for extruding metal alloys under high flow stress conditions wherein the extrusion die has a service life similar to known extrusion dies used for low flow stress monolithic aluminum alloys.

It is another object of the invention to provide a method and apparatus for extruding metal alloys, as above, wherein the microcrystalline structure of the alloy is substantially unaltered by the extrusion step.

It is yet another object of the invention to provide a method and apparatus for extruding a metal alloy, as above, which allows rapid extrusion of high flow stress alloys.

It is still another object of the invention to provide a method and apparatus as above, which requires minimum down time and allows rapid turn around between production runs.

These objects and other set forth hereinbelow, are achieved by extruding a metal alloy under conditions of high flow stress, comprising forming a billet comprising the alloy to be extruded, heating the billet to a temperature of from about 75° to about 10° F. below the solidus temperature of the alloy, and extruding the billet through an extrusion die maintained at a temperature of from about 75° to about 10° F. below the solidus temperature of the alloy.

BRIEF DESCRIPTION OF THE DRAWINGS

For a full understanding of the invention, the following detailed description should be read in conjunction with the drawings, wherein.

DETAILED DESCRIPTION OF THE PREFERRED EMBODIMENTS

Figure 1:
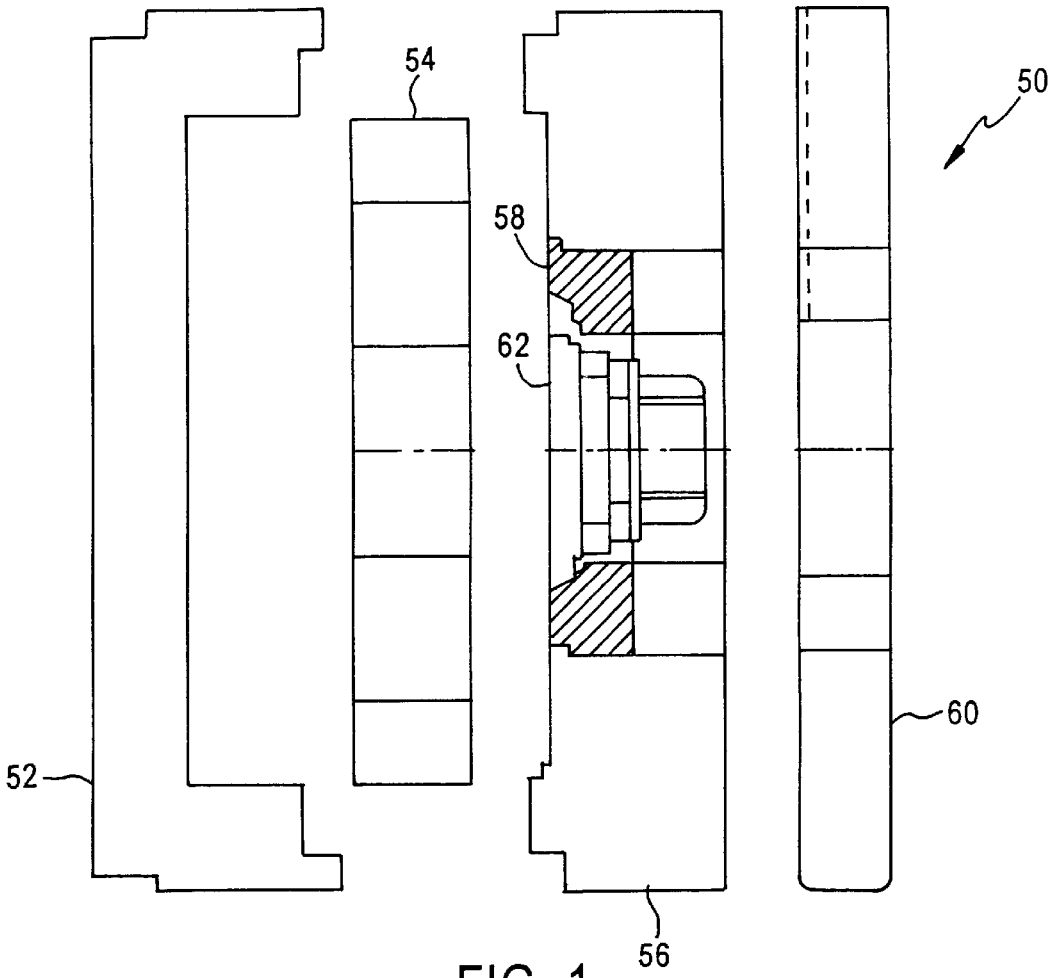
FIG. 1 is a cross-sectional view of an extrusion die useful in the invention.

The extrusion method and apparatus of the invention may be used for a wide variety of alloy composition including but not limited to 5xxx, 6xxx and 7xxx series aluminum alloy matrices having high volume loadings of refractory particulates. The refractory particulates include those which contribute to increased strength and concomitant high flow stress, such as various aluminas, silicon carbide, boron carbide, aluminum nitride and silicon hexaboride. The extrusion method and apparatus find particular utility in extruding alloys having a modulus of about 13,000,000 psi or greater. Specific examples of such composition include superhypereutectic Al/Si alloys containing up to 40 weight % silicon and discontinuous reinforced metal matrix composites comprised of an aluminum alloy matrix and various carbide particulate reinforcement phase. Other examples of high modulus alloy systems are beryllium/aluminum alloys, titanium aluminide, nickle aluminide, and iron aluminide to name a few candidate materials.

A preferred technique for forming an alloy for extrusion in the apparatus of the invention is as follows:

A pre-alloyed powder is formed by subjecting an aluminum alloy melt to a powder metallurgy technique. The term "pre-alloyed" means that the molten aluminum alloy bath is of the desired chemistry prior to atomization into powder. In a highly preferred embodiment, the alloy melt is passed through a nozzle to form an atomized stream of the melt which is cooled at a rapid rate by an inert gas stream (e.g., argon or helium impinging the atomized stream. Cooling takes place at a rate of about 1000° C. (1832° F.) per second, producing a spherical-shaped powder. THE powder has an oxide layer, but he thickness of this layer is minimized due to selection of inert gas as the cooling fluid. It is possible to use water on air as the cooling fluid, but the oxide layer thickness is increased. Preferably no other low melting alloy addition is blended with the alloy composition.

The aluminum alloy powder is blended with particulates of one or more refractory materials comprising from about 2 to about 45% by volume of the overall composition.

After the aluminum alloy powder and refractory particulates are uniformly mixed, they are subjected to a compacting step whereby the mixture is placed in a urethane elastomeric bag, tamped down and vibrated, and then subjected to vacuum to remove air and other gaseous materials. The vacuum is generally 10 torr or less absolute pressure. After vacuum is applied for a period of from about 2.5 to about 5 minutes, the compressed particulates are subjected to isostatic compression at a pressure of at least about 30,000 psi, preferably at least about 60,000 psi. This isostatic compaction takes place at a temperature of less than about 212° F. (100° C.), and preferably less than about 77° F. (25° C.), i.e. about room temperature.

The resulting "green" billet is then vacuum sintered at a temperature which is a function of the particular alloy composition. In many cases, particulate microstructure is left substantially unaffected. By the term "substantially unaffected" is meant that while the majority of the sinter bonds are formed by metallic diffusion, a small amount of melting can occur, however, this amount does not change the physical properties of the aluminum alloy powder to an extent that would affect the strength of the subsequently formed article. Generally, the sintering temperature is within 50° F. (28° C.) of the solidus of the particular composition, but may be higher or lower depending on the sintering characteristics desired. The term "solidus" refers to the point of the incipient melting of the alloy and is a function of the amount of alloying materials present, e.g. magnesium, silicon, etc. The vacuum under which sintering takes place is generally 100 torr or less absolute pressure. The sintered billet is then extruded as described below.

The inventors have discovered that successful extrusion of a wide variety of aluminum alloy matrices and carbide particulate reinforcement loadings (up to 40 percent by volume) is possible without the necessity of using ceramic die inserts with their attendant problems. In order to accomplish this, the extrusion press hydraulic system, container, platen and stem are designed to consistently survive the die face pressure by 30 percent minimum to overcome the higher flow stress that AIMMC materials exhibit compared to monolithic conventional aluminum alloys.

The extrusion die tooling is designed, and in some instances alloy compositions of the extrusion die materials optimized, to avoid deflection of the die. All of the die components are assembled in compression at the extrusion die operating temperature. Die deflection can cause catastrophic failure during the extrusion cycle.

Non metal bearing inserts are incorporated in the extrusion tooling to resolve the wear problems that AIMMC materials exhibit because of their extremely abrasive characteristics.

A preferred extrusion process includes provisions for maintaining extrusion die temperature within close tolerances, i.e. within about ±50° F. (28° C.) of a target temperature, desirably within about ±30° F. (17° C.), and preferably within about ±15° F. (8° C.) of a target temperature. The actual target temperature is itself a function of the particular alloy being extruded but is typically between about 930° F. (499° C.) and about 970° F. (521° C.). It is highly preferred that the extrusion temperature not exceed the solidus temperature. The extrusion temperature is preferably measured at the exit of the die, thus accounting for temperature effects due to friction and working of the billet.

As illustrated in FIG. 1, an extrusion die useful in the invention is indicated generally by the number 50 and includes a feeder plate 52, a mandrel/spider 54, and O.D. bearing plate 56, a die insert holder assembly 58 and a backer plate 60. All of the sections are interference fitted to be in compression at the extrusion die temperature. The compression fit strengthens the die to prevent deflection of the die components. Within the die holder assembly 58 is fitted a bearing retainer assembly 62.

Figure 2:
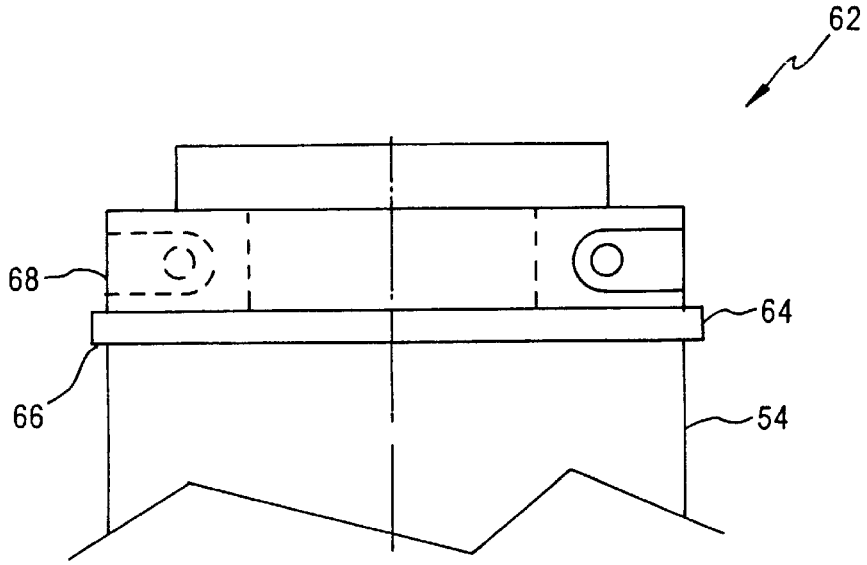
FIG. 2 is an illustration of a bearing retainer assembly used in the extrusion die of FIG. 1.

FIG. 2 illustrates the bearing retainer assembly in detail. As shown in FIG. 4, a nonmetal insert 64 is positioned on a recessed surface 66 of the mandrel/spider 54. Over the insert 64 is placed a collar 68. Within the bearing retainer assembly is a pocket (not shown) for preworking the alloy prior to final extrusion through the O.D. bearing plate 56. The pocket has an entry angle of from about 30 to 32° and is positioned about 0.75 inches prior to the O.D. bearing plate 56. As the material passes through the pocket, it is preworked by shearing action. This aids in removal of the oxide layer from the particulates and in forming metal to metal bonds.

One or more, and preferably all of the above components of the extrusion die may be constructed of Inconel 718 or another alloy having a yield strength equivalent to or greater than that of Inconel 718 at 900–1000° F. (482–538° C.) to prevent deflection or mandrel "stretch" due to high temperature creep. This is particularly important at die face pressures greater than 95,000 psi at 900° F. (482° C.). At die pressures below this level, the extrusion die may typically be constructed of H13 tool steel.

The nonmetal insert 64 is preferably micrograined tungsten carbide (less than one micron diameter grain size) with a cobalt binder level between about 12% and 15%. This material exhibits a minimum transverse rupture strength of 600,000 psi. The use of Inconel 718 as the die insert holder with the tungsten carbide insert minimizes the possibility of cracking of the insert due to differences in coefficient of thermal expansion.

The extrusion container temperature is maintained within the same temperature limits as the extrusion die. In both cases, this may be accomplished by microprocessor controlled resistance band heaters or cartridge type heaters strategically placed on the extrusion container. Temperature is measured by multiple thermocouples imbedded in the die and container adjacent the container surface (generally within ½ inch of critical forming surfaces). Each portion of the extrusion container and die tooling stack monitored by a thermocouple has independent temperature control.

Figure 3A:
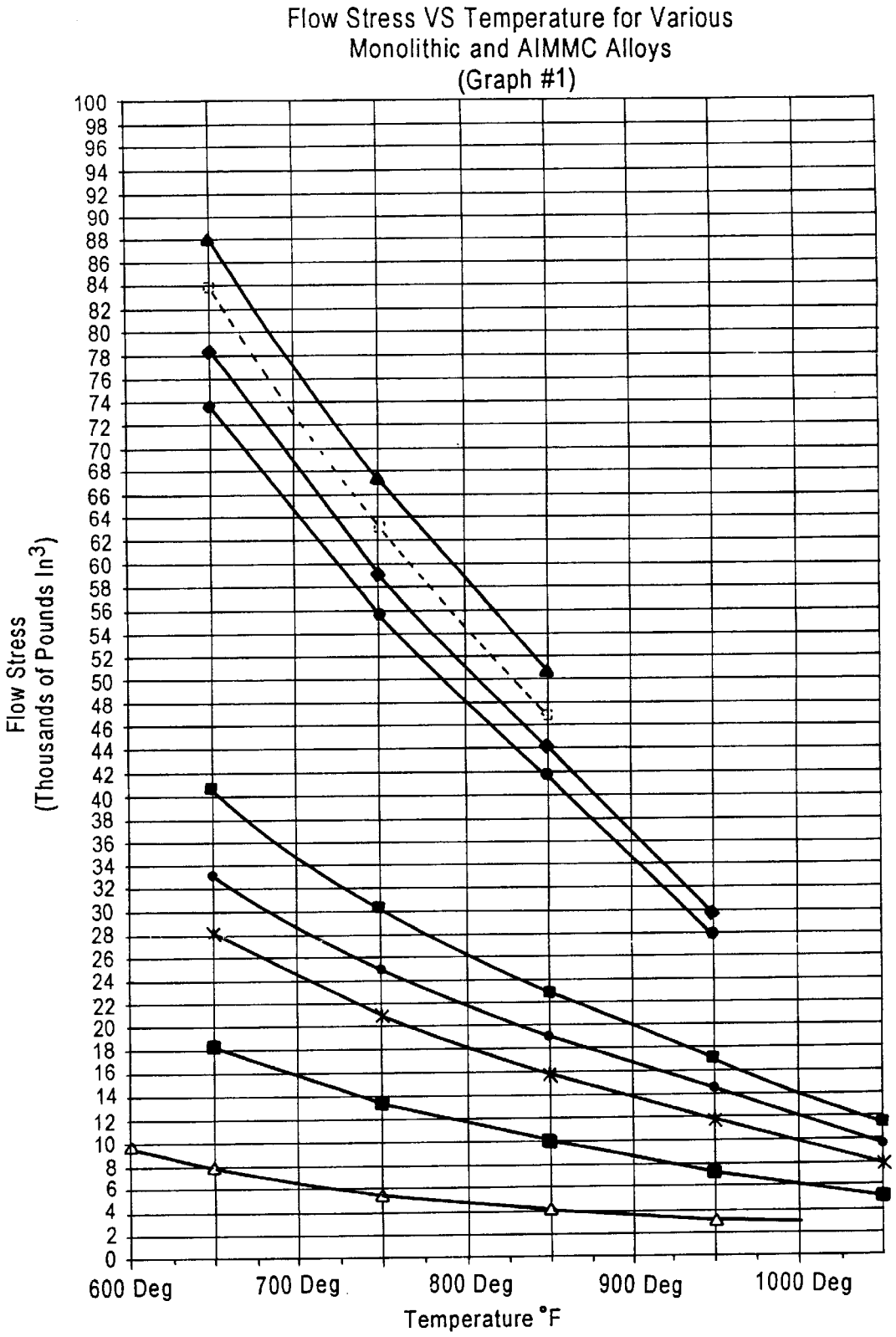
FIG. 3 is a graph of flow stress vs. temperature for various alloys.
Figure 3B:
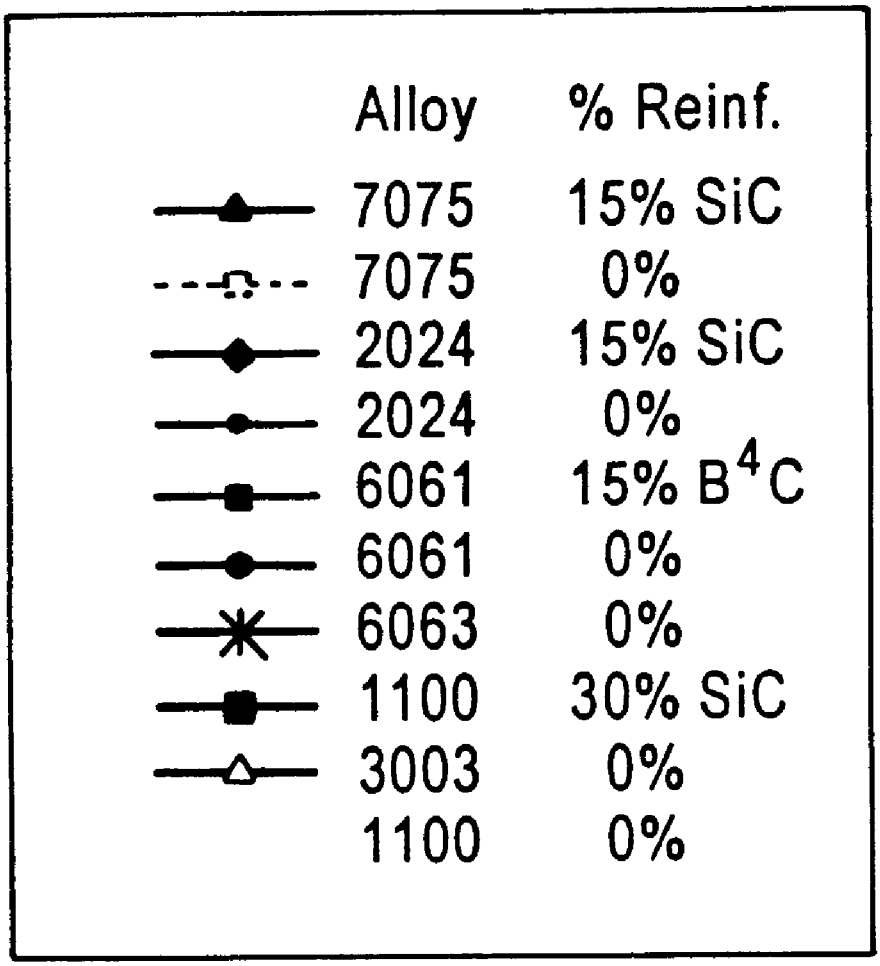

In the extrusion process of the invention, the extrusion tooling is designed for a given flow stress. This flow stress is controlled by the matrix alloy, type of reinforcement, volume loading of the particulate reinforcement, and the effect of temperature. FIG. 3 is a graph of flow stress vs temperature for various monolithic and AIMMC alloys. As shown in FIG. 3, when the carbide particulate loading in a given matrix alloy, the flow stress increases dramatically. Changing the monolithic alloy composition has the same proportional influence on the increased flow stress as the reinforcement level in the aluminum composite material. The 1100, 3003, 6063, and 6061 conventional monolithic (no carbide reinforcement phase) are considered "soft" alloys while the 2024 and 7075 alloy matrices are considered "hard" alloys. FIG. 4 is a graph which plots the flow stress versus temperature in various compositions to extrude a 2.00"W×0.375"T rectangle profile on a 1572 ton extrusion press for a 6.375" ID container. From this graph, it can be seen that if a 7075+15v/oSiC composition is to be extruded into the 2.00"W×0.375"t rectangle profile that the total temperature process window is only 75°. This illustrates the need for tight temperature control during extrusion.

Increasing the billet temperature above solidus temperature of a given alloy composition results in degradation of mechanical properties and extrusion surface finish. In a preferred embodiment, the extrusion exit does temperature not exceeding the solidus temperature for a given composition. Another reference point regarding the maximum allowable extrusion exit temperature is the recommended solution heat treat temperature for a given matrix alloy composition as indicated by various military and aerospace heat treating specifications.

On profiles and AIMMC compositions that have die face pressures greater than 95,000 psi at 900° F., Inconel 718 nickel based super alloy is used in specific sections of the die to prevent deflection or mandrel "stretch" due to high temperature creep. Inconel 718 improves the high temperature yield strength, stress ruptures and improved creep resistance. If the die face pressure is less than 90,000 psi at above 900° F., the die material is typically H13 tool steel.

On both solid shape and hollow profile extrusion die designs it is preferred that the process allows for a performing zone prior to the final bearing area of the tool. This is typically done in the metal insert holder with a pocket area that has a 30–32' angle for optimum sheer performing zone.

The non-metal insert material is preferably micro grained tungsten carbide (less than 1 micron diameter grain size) with a cobalt binder level between 12–15% while exhibiting a minimum transverse rupture strength of 600,000 psi. The insert holder is preferably Inconel 718 to closely match the coefficient of thermal expansion (CTE) of the tungsten carbide. This close CTE match between the tungsten carbide (WC) and the Inconel 718 alloy is important during the interference fitting operation to assure compression loading of the WC insert at the extrusion temperature and reducing the stress on the WC insert at room temperature. If there is to great of CTE mismatch between the nonmetal insert and the holder, the compressive forces at room temperature will crack the WC insert.

A preferred extrusion container design has interior heating elements that run the entire length of the container and allow independent heating and controlling of temperature. The container is divided into 4–6 sections each having its own control and over-temperature thermal couple control system. The container temperature is controlled within ±15° F. temperature gradient over the entire length and periphery of the container.

In a highly preferred embodiment, the extrusion die, backer plate, and bolster support tooling are all heated by resistant heated band heaters controlled by a stand alone control panel. THE extrusion die thermal couple is embedded in the die within ½" of the outside diameter bearing area of the extrusion die. This location of the extrusion die does the final forming of the alloy which controls the dimensions and surface finish of the extruded profile. Each section of the support tooling is independently controlled by the same embedded thermal couple monitoring to remove the temperature gradient that occurs between the heated backup tool and the room-temperature extrusion press platten. All heaters are sized to a minimum of 6 watts per cubic inch of tool mass, assuming a solid tool stack.

Monolithic alloys employ a die plate with a varying bearing lengths to control flow of the extrudant to maintain dimension quality. This means that the bearing land varies in length across the width of a profile to speed up or slow down metal flow to obtain balanced flow.

The use of non-metal bearing inserts does not allow variation of the bearing and length across the profile. Also, these inserts are preferably interference fitted to keep them in compression during extrusion. To control flow, a preform plate is used to control flow across the profile. This preform plate serves two purposes, the first is to preclude the formation of dead metal zones at the entry port and to keep the material active until it reaches the shear edge. The shear edge then is varied to created areas of dead metal zones thus causing longer or shorter shear planes. Changing the distance of the sheer planes is the mechanism used to control flow across the final bearing area.

Monolithic alloys took design incorporates an O.D. bearing "cap," a "core" which is actually an I.D. mandrel attached to a series of webs. These webs created a path for the metal to reach the O.D. bearing "cap" and when the metal reaches the cap, the metal starts to fill the weld chamber surrounding the I.D. mandrel. When enough pressure is applied to this metal it begins to flow across the O.D. bearing and over the I.D. mandrel bearing and to control metal flow across the bearings the bearing land length is varied to create various levels of friction. This variation in friction controls metal flow. The greater the friction that is created, the slower the metal flows in that section of the die.

With MMC and RSP materials, we use a ported feeder plate, a spider and mandrel assembly, an O.D. bearing plate, and non-metal bearing insert. Again to control flow of material across a profile we incorporate preform entry inserts generally made from H-13 or INCO-718 depending on the extrusion alloy and interior loading of dic. All of the components interference fitted to withstand the higher unit pressure loading experienced with these advanced materials in die deflection. By changing the angularity of the port holes and spider sections of the tool design, a 70% improvement in linear loading is applied to the spider section for support to prevent die deflection or total collapse of the tool during extrusion.

Monolithic alloys employ an O.D. bearing plate utilizing interference fitted change H-13 or non-metal bearing material. The I.D. bearing is attached to a piercing mandrel which, during extrusion, pierces the billet and is positioned inside of the O.D. bearing the metal is then extruded creating a non-welded extrusion or seamless hollow cross-section. Again metal flow is controlled by variation of the bearing land area across the profile cross-section.

With MMC and RSP materials, the bearing materials are always non-metal insert. Typically the billets are manufactured with a bore (hollow) in the direction of extrusion so as not to use the mandrel to pierce the billet. Unlike monolithic aluminum alloys, AIMMC material billets cannot be pierced because of the alloys high flow stress without deflecting die extrusion piercing stem. The stem is brought to a position in front of the O.D. insert and allowed to be brought into position by the upsetting friction of extrusion.

We incorporate a reverse entry insert to alloy material to be captured and pressurized metal support between this entry insert and the O.D. bearing insert. This creates a pocket of material to center the I.D. mandrel to prevent collision between the I.D. bearing mandrel and the O.D. bearing insert during the extrusion process.

What is claimed is:

1. A method for extruding a metal alloy under conditions of high flow stress, comprising the steps of:

(a) forming a billet comprising the alloy to be extruded (b) heating the billet to a temperature of from about 75° to about 10° F. below the solidus temperature of the alloy, and (c) extruding the billet through an extrusion die maintained at a temperature of from about 75° to about 10° F. below the solidus temperature of the alloy.

2. A method as claimed in claim 1, wherein the step of extruding the billet through an extrusion die includes extruding the billet through an extrusion die having a non-metal bearing insert.

3. A method as claimed in claim 2, wherein the non-metal bearing insert comprises one of tungsten carbide or another material having equivalent or superior wear resistance and thermal shock resistance characteristics.

4. A method as claimed in claim 2, wherein the extruding step includes extruding a thin walled, narrow hollow extrusion profile article using a non-metal bearing insert using a split bearing support assembly to prevent failure of the non-metal bearing insert material.

5. A method as claimed in claim 1, wherein the step of extruding the billet through an extrusion die includes extruding the billet through an extrusion die wherein all parts of the die are maintained in compression at the extrusion temperature.

6. A method as claimed in claim 2, wherein the step of extruding the billet through an extrusion die includes extruding the billet through an extrusion die wherein all parts of the die are maintained in compression at the extrusion temperature.

7. A method as claimed in claim 1, wherein the step of extruding the billet includes working the alloy in a pocket upstream of the extrusion die bearing area.

8. A method as claimed in claim 2, wherein the step of extruding the billet includes preworking the alloy in a pocket upstream of the extrusion die bearing area prior to a final forming location.

9. A method as claimed in claim 5, wherein the step of extruding the billet includes working the alloy in a pocket upstream of the extrusion die bearing area.

10. A method as claimed in claim 1, wherein the metal alloy is an aluminum alloy formed by powder metallurgy.

11. A method as claimed in claim 10, wherein the aluminum alloy matrix is selected from the group consisting of silicon, magnesium, zinc, copper, and 1100, 2000, 5000, 6000 and 7000 series aluminum alloys and mixtures thereof.

12. A method as claimed in claim 11, wherein the billet comprises a sintered billet of hypereutectic aluminum silicon having a silicon content up to 40% weight.

13. A method as claimed in claim 11, wherein the billet comprises a sintered billet selected from the group consisting of silicon, boron carbide, silicon carbide, silicon hexaboride, aluminum nitride having up to 40% reinforcement volume loading.

14. A method as claimed in claim 1, wherein the billet comprises an alloy having a modulus of at least about 13,000,000 psi.

15. A method for forming an extruded article, comprising the steps of:

(a) forming an aluminum or aluminum alloy powder;

(b) mixing the powder of step (a) with particulates of a refractory material, thereby forming a particulate mixture;

(c) compacting the particulate mixture in a mold;

(d) subjecting the compacted particulate mixture to a vacuum of less than about 10 torr absolute pressure to remove air and other gaseous materials from between the particulates in the mixture and the mold;

(e) isostatically compressing the particulate mixture to a pressure of less than about 30,000 psi and at a temperature of less than about 100° C., thereby forming a green billet;

(f) vacuum sintering the green billet under a vacuum of less than about 100 torr absolute pressure and/or an inert gas environment at a temperature less than that which substantially affects the particulate microstructure, thereby forming a sintered billet; and (g) extruding the sintered billet and forming metal to metal bonds between the sintered particulates of the billet, thereby forming the extruded article.

16. A method for extruding a metal alloy under conditions of high flow stress, comprising the steps of:

(a) forming a billet comprising the alloy to be extruded (b) heating the billet to a temperature of from about 50° to about 5° F. below the solidus temperature of the alloy, and (c) extruding the billet through an extrusion die maintained at a temperature of from about 50° to about 5° F. below the solidus temperature of the alloy.

17. A method as claimed in claim 16, wherein the billet is heated to a temperature of from about 25° to about 5° F. below the solidus temperature of the alloy and the extrusion die is maintained at a temperature of from about 25° to about 5° below the solidus temperature of the alloy.

* * * * *